US006609804B2

(12) United States Patent
Nolan et al.

(10) Patent No.: US 6,609,804 B2
(45) Date of Patent: Aug. 26, 2003

(54) LED INTERIOR LIGHT FIXTURE

(76) Inventors: Steven T. Nolan, 4260 Arthur La., Beaumont, TX (US) 77706; Donald R. Hebert, 1007 Gene Dr., Lumberton, TX (US) 77657

( * ) Notice: Subject to any disclaimer, the term of this patent is extended or adjusted under 35 U.S.C. 154(b) by 0 days.

(21) Appl. No.: 09/976,901

(22) Filed: Oct. 15, 2001

(65) Prior Publication Data

US 2003/0072145 A1 Apr. 17, 2003

(51) Int. Cl.[7] ..... F21V 19/04

(52) U.S. Cl. ..... 362/20; 315/86; 315/87; 315/194; 323/905

(58) Field of Search ..... 362/20, 800; 315/86, 315/87, 194; 323/905

(56) References Cited

U.S. PATENT DOCUMENTS

| | | | | | |
|---|---|---|---|---|---|
| 2,476,517 | A | * | 7/1949 | Titus | 362/20 |
| 2,715,197 | A | * | 8/1955 | Dubroff et al. | 323/905 |
| 2,946,903 | A | * | 7/1960 | Osborne et al. | 323/905 |
| 3,032,688 | A | * | 5/1962 | Spira | 323/905 |
| 3,422,309 | A | * | 1/1969 | Spira et al. | 315/194 |
| 3,500,455 | A | * | 3/1970 | Ross et al. | 315/194 |
| 3,659,179 | A | * | 4/1972 | Barker et al. | 315/87 |
| 3,935,505 | A | * | 1/1976 | Spiteri | 315/194 |
| 4,349,863 | A | * | 9/1982 | Petersen | 315/86 |
| 4,727,291 | A | * | 2/1988 | Bavaro | 362/20 |
| 4,733,335 | A | * | 3/1988 | Serizawa et al. | 362/373 |
| 4,985,661 | A | * | 1/1991 | Lin | 362/20 |
| 5,655,830 | A | | 8/1997 | Ruskouski | |
| 5,734,229 | A | * | 3/1998 | Bavaro et al. | 315/86 |
| 5,752,766 | A | * | 5/1998 | Bailey et al. | 362/250 |
| 5,848,837 | A | | 12/1998 | Gustafson | |
| 6,016,038 | A | | 1/2000 | Mueller | |
| 6,149,283 | A | | 11/2000 | Conway | |
| 6,163,038 | A | | 12/2000 | Chen | |
| 6,203,180 | B1 | * | 3/2001 | Fleischmann | 362/147 |
| 6,218,785 | B1 | | 4/2001 | Incerti | |
| 6,220,722 | B1 | * | 4/2001 | Begemann | 362/241 |
| 6,227,679 | B1 | | 5/2001 | Zhang | |
| 6,250,774 | B1 | | 6/2001 | Begemann | |
| 6,268,801 | B1 | | 7/2001 | Wu | |
| 6,367,949 | B1 | * | 4/2002 | Pederson | 362/247 |
| 6,431,728 | B1 | * | 8/2002 | Fredericks et al. | 362/249 |

OTHER PUBLICATIONS

Andrew Bierman; *LEDS: from indicator to illumination* Lighting Futures, vol. 3 No. 4, 1998 Rensselaer Polytechnic.

Neil Savage; *LEDs Light the Future*; Technology Review, Sep. 2000 www.technologyreview.com/magazine/sep00/savage.asp.

Photon Lamp, Ultra Efficient Solar Lighting System www.photonlamp.com.

The Light Source: Ultrabright Light Emitting Diodes www.railwaylights.com/content/our_technology/light_source.html.

Kenneth Betz; Energy User News: *Little Things Mean a Lot*Aug. 10, 2001. www.energyusernews.com/CDA/ArticleInformation/features/BNP_Features_Item/0 . . .

* cited by examiner

*Primary Examiner*—Alan Cariaso
*Assistant Examiner*—Ismael Negron
(74) *Attorney, Agent, or Firm*—Randal D. Homburg

(57) ABSTRACT

A low voltage ceiling or wall mounted light fixture for residential and commercial lighting includes a plurality of high lumen white LED lights incorporated within the fixtures, a light color diffusion panel and a household current to low voltage DC converter within the fixture to convert the AC current to low voltage DC current, reducing the power required for illumination without replacement of the LED lights.

2 Claims, 3 Drawing Sheets

LED INTERIOR LIGHT FIXTURE

CROSS REFERENCE TO RELATED APPLICATIONS

None

I. BACKGROUND OF THE INVENTION

1. Field of Invention

The invention is a low voltage ceiling or wall mounted light fixture for residential and commercial lighting, having included a plurality of high lumen white LED lights incorporated within the fixtures, a light color diffusion panel and a household current to low voltage DC converter within the fixture to convert the AC current to low voltage DC current, saving on the cost of power required to provide illumination for the resident or commercial application and virtually eliminating the need to replace incandescent or fluorescent bulbs, the LED lights having an average duration of over 150,000 hours.

2. Description of Prior Art

The following United States patents and publications were discovered and are incorporated and disclosed within this application for utility patent. All relate to LED lighting devices and technology.

In U.S. Pat. No. 6,149,283 to Conway, et al., an LED lamp with a reflector and a multi-color adjuster is disclosed, the bulb having an Edison bulb base, which allows for the choice of color by turning knobs located on the sides of the bulb. A multi-colored LED lighting array is disclosed in U.S. Pat. No. 6,016,038 to Mueller, et al., this device having an LED light array of red, blue and green LEDs controlled by a computer programming means.

A low-tension lighting device is provided with one or more LEDs having a control circuit to produce a low consumption, long-life lighting source, the device having a conventional screw-type mounting base for connection to a standard light socket. In U.S. Pat. No. 5,848,837, an LED is included in a integrally formed linear strip, which would mainly be used for marking paths or to define a low lumen decorative edge lighting, but marginally useful for actual area illumination.

A method and apparatus for retrofitting a traffic signal lamp with an LED lamp module is disclosed in U.S. Pat. No. 6,268,801 to Wu and. This patent discloses a high lumen variation of an LED as traffic control devices must be seen in daylight from a fairly good distance. Two more LED light bulbs are disclosed in U.S. Pat. No. 6,227,679 to Zhang, et al., and U.S. Pat. No. 5,655,830 to Ruskouski, these bulbs replacing conventional bulbs with arrays of LED lights. A luminaire is disclosed in U.S. Pat. No. 6,250,774 to Begemann, et al., which describes the use of LEDs for exterior illumination. It mentions specifically using LED arrays for street lights, floodlights and other types of outdoor lighting, describing specific types and styles of fixtures and their general design. This patent discloses that LEDs can be used for high-lumen lighting, referencing only the quantity of illuminating lumens without specifics as to quality of illumination, mainly concerning with spot lighting illumination.

A white light-emitting diode and method of manufacture is disclosed in U.S. Pat. No. 6,163,038 to Chen, et al. This type of white light LED is preferred as the LED utilized in the present invention, which incorporates a plurality of white light LEDs into each fixture variation of the present invention.

Several other publications refer to LED technology and lighting, although not addressing the specific nature of the present invention. In an educational article found at http://www.lrc.rpi.edu/futures/LF-LEDs/index.html by the Rensselaer Polytechnic Institute in Lighting Futures "LEDs: From Indicators to Illumination?", Volume 3 Number 4, 1998, a discussion is held regarding the future use of LED's for general purpose lighting, if only the bright white LEDs would ever become available.

In Technology Review, September/October 2000, an article entitled "LEDs Light the Future", by Neil Savage, future use of LEDs for general lighting is also discussed. However, at that time, high lumen output LEDs produced a very bland white light. Unlike normal white light, which is a combination of all the light of the visible spectrum, white LEDs produce only a very narrow band of visible light output, resulting in a very dull and grey white light. Color perception under this lighting is quite poor.

A bright light LED desk lamp is displayed in an advertisement for a photon lamp, the web site located at http://www.photonlamp.com/. This lamp uses bright white LED lighting using a Nickel Metal Hydride battery pack with a solar module recharger allowing the lamp to be used for up to 3 hours per charge, with a 100,000 hours of usage on the light bulbs, with an optional 115 VAC wall cube operation and recharger for the batter pack.

Ultrabright Light Emitting Diodes are used for railroad lighting replacements of incandescent bulbs in an article for RailwayLights.com, wherein LED light arrays are used to replace conventional railway lights supplied in blue, yellow, red and green light replacements, focusing on the lowered radiation output, the longer life and the lowered electrical usage of these replacement lights.

II. SUMMARY OF THE INVENTION

The primary objective of the invention is to provide an indoor lighting fixture utilizing a plurality of bright white LEDs to produce a high lumen output ceiling light fixture utilizing a small portion of the electricity required to illuminate a conventional lighting fixture.

A secondary objective of the invention is to provide the indoor lighting fixture utilizing a plurality of bright white LEDs to produce a high lumen output ceiling light fixture which does not require replacement of any bulbs or lighting tubes during the reasonable life of the fixture.

A third objective of the invention is to provide the light fixture with an AC/DC power converter in the fixture having an input for an emergency power supply including an automobile battery or other DC battery backup source, allowing for several fixtures to be daisy-chained for full residential and commercial illumination in the event of a power outage or shortage.

A fourth objective of the invention is to provide the light fixture with separate DC power input and output, allowing the fixture not only to be operated with available DC power, but to allow for the hook up of several fixtures in series for residential and commercial illumination, hooking one light fixture to another, operating several units on a single low voltage DC power supply. In addition, alternative power supplies, including solar cell, wind turbine, and water wheel generators could provide the low voltage DC power supply since these fixtures are quite energy efficient LED lighting has several advantages over conventional lighting, including incandescent and fluorescent lighting. With incandescent bulbs, almost 85% of the energy used in the bulb is given off as heat making them quite inefficient as a light source. Due to their design, these bulbs have a very short lifespan and require frequent replacement. A great deal of light fixture design is concerned with protection from heat or requiring the incorporation of small low wattage low lumen bulbs, due to the excessive heat produced by conventional incandescent bulbs. Conventional incandescent fixtures are designed with concern for heat, bulb replacement access, bulb size and code requirements for 110 volt and 220 volt AC wiring.

Dimmer switches used on incandescent fixtures have a high level of resistance and, as result, also can give off huge amounts of heat due to the resistance of the 115 volt household current. Fires and electrocutions are possible with conventional lighting fixtures and wiring.

With fluorescent lamps, 110 or 220 volt current is still required and they are operated by very expensive ballasts, which do not withstand time or exposure to heat. They are long and cumbersome to replace, and if they explode due to slight contact, they can become quite dangerous, with sharp, flying glass fragments. Fluorescent bulbs generally cannot be dimmed, although some are equipped with a dimmer, tend to flicker, which is disturbing to a user. Some fluorescent bulbs are equipped with Edison light bulb attachments, but these are usually bigger than their incandescent replacement subjects and can disrupt the fixture to which they are applied.

With the present invention, the advantages associated with the incorporation of the bright white LEDs into the fixture lie in the energy efficiency of the lighting, producing the same amount of visible area lighting using a mere fraction of the energy as incandescent and fluorescent bulbs. Using the color spectrum diffusion element over the bright white LEDs produces a color enhanced light giving such LED light the same character as conventional lighting. LED bulbs have a much greater lifespan, thereby making the bulbs in the fixture virtually free from replacement, allowing the direct incorporation of the LEDs into the fixture, providing a much more flexible use without concern over excessive heat, bulky bulbs or replacement access, such LEDs providing in excess of 100,000 hours of light. Additionally, emergency lighting can be gained using the household lighting and a DC battery, including hooking your household lighting into a car cigarette lighter for emergency household lighting during a power outage or shortage. Adaptation to existing solar power is also an available option for this low consumption lighting system and fixture.

III. DESCRIPTION OF THE DRAWINGS

The following drawings are submitted with this utility patent application.

Figure 5A:
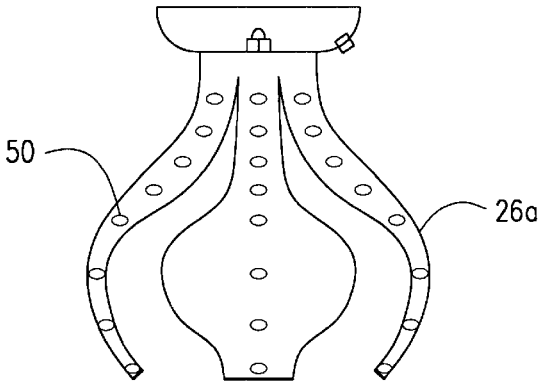
Figure 5B:
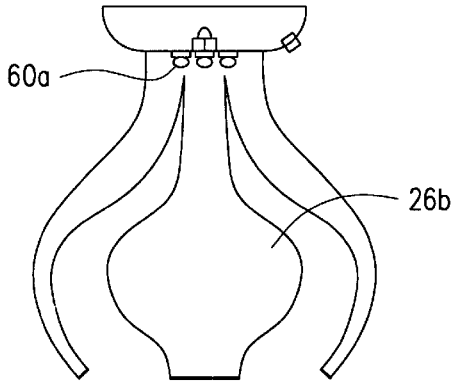
Figure 5C:
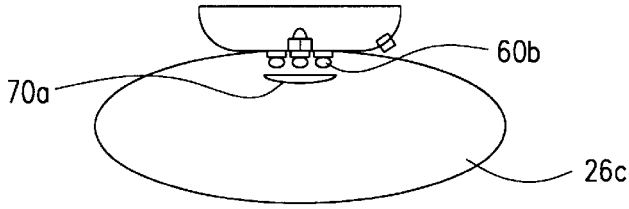
Figure 5:
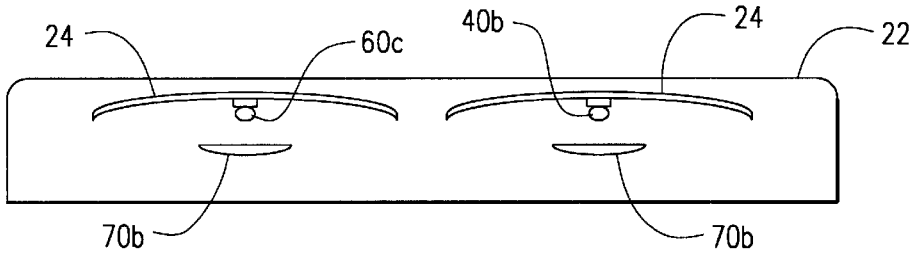

FIGS. 5*a*, 5*b* and 5*c* are three variations of the LED arrangement in a fixture.

FIG. 6 is a side view of a flush mounted ceiling fixture embodiment, including a bright white LED cluster with a reflective backing plate and a colorized diffusion panel.

IV. DESCRIPTION OF THE PREFERRED EMBODIMENT

The invention, as shown in FIGS. 1–6 of the drawings, is an interior light fixture using bright white LEDs for an illumination source, powered by a low voltage DC current, the invention comprising a multiple terminal low voltage power supply 30*a*, 30*b* which may be installed above or directly below a ceiling 100*a*, 100*b* or wall surface, and wired into a standard household or commercial electrical system 110, one or more ceiling or wall installed low voltage DC current bright white LED light fixtures 20*a*, 20*b* containing one or more bright white LED light sources 40*a*, 40*b*, connected to the multiple terminal low voltage power supply 30*a*, 30*b*, the multiple terminal low voltage power supply 30*a*, 30*b* also attached to a DC light switch 80*a*, 80*b*, a DC dimmer switch 82*a*, 82*b* and having an auxiliary power terminal 90*a*, 90*b* which may be attached to an alternate DC power supply in the event of an AC power outage or shortage. For purposes of this device, bright white LEDs are defined to include those LEDs, regardless of size, lumen output or shape, which produces a spectrum of light wavelengths which appear white, near white or close to a natural light, to a human observer.

Figure 1:
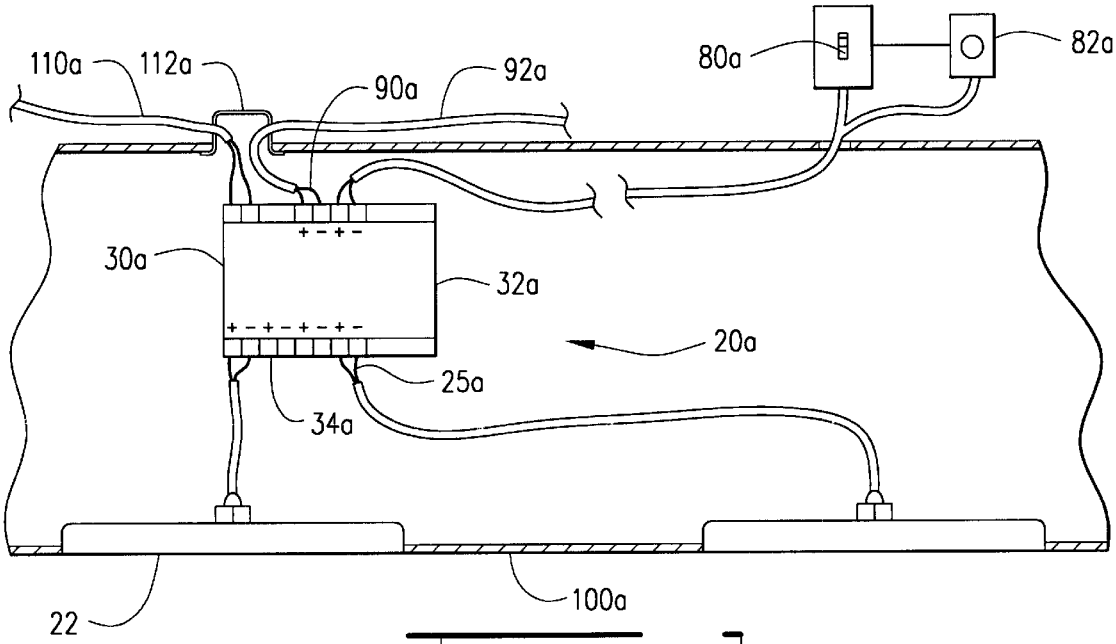
FIG. 1 is a drawing of the invention in a flush mount ceiling fixture.
Figure 2:
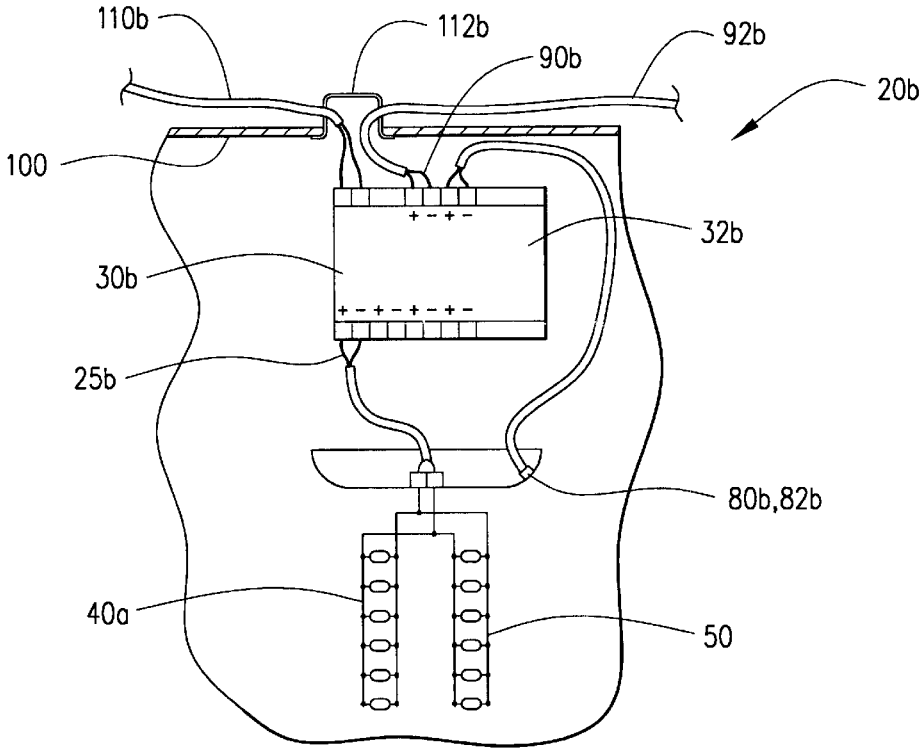
FIG. 2 is a drawing of the invention is a drop light ceiling fixture.

The multiple terminal low voltage power supply 30*a*, 3*b* further includes a transformer 32*a*, 32*b* converting 110 and 220 AC current to low voltage DC current, multiple attachment terminals 34*a*, 34*b* accepting at least one paired wire connection 25*a*, 25*b* to the bright white LED light fixtures 20*a*, 20*b*. This multiple terminal low voltage power supply 30*a*, 3*b* may be directly wired into an AC electrical junction box 112*a*, 112*b* positioned above the ceiling 100*a*, 10*b* or in a wall. The bright white LED light fixtures 20*a*, 20*b*, as shown in FIGS. 1–2 and 5*a*–6, may be provided in a variety of shapes and configurations. FIG. 1 shows a flush mounted ceiling fixture embodiment above the ceiling 100*a*, while FIG. 2 indicates a drop ceiling fixture embodiment below the ceiling 100*b*. FIG. 5*a* indicates a light fixture with the bright white LED light source being multiple strands 50 of bright white LEDs embedded within a globe portion 26*a* of the bright white LED light fixture 20, while FIG. 5*b* shows the light fixture 20*b* with the bright white LED light source as a bright white LED cluster 60*a* above a globe portion 26*b* of the bright white LED light fixture. FIG. 5*c* illustrates the light fixture 20*b* having a bright white LED cluster 60*b* with a colorized diffusion panel 70*a* below the bright white LED cluster 60*b* within a globe portion 26*c*.

Figure 4:
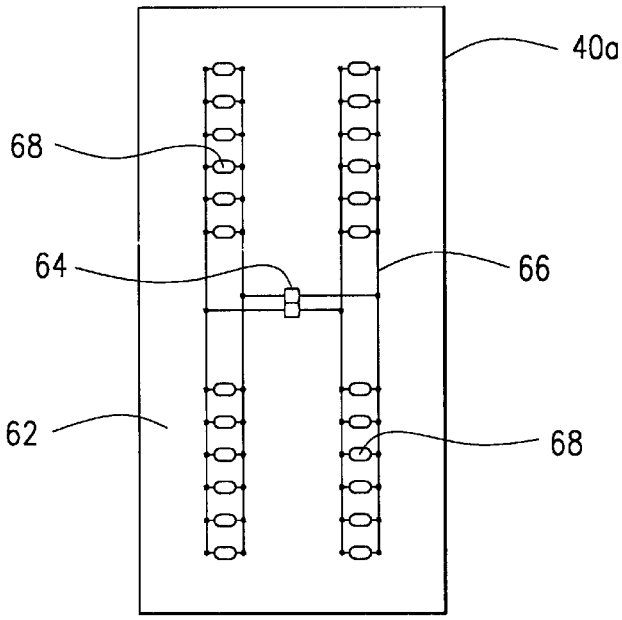
FIG. 4 PRIOR ART
FIG. 4 is a drawing of the typical wiring of an LED array.

A closer view of an example of a typical bright white LED light source 40*a* is shown in FIG. 4, which illustrates a cluster panel backing material 62, DC contact points 64, and low voltage electrical wiring 66 connecting a multiplicity of bright white LED lamps 68 in a parallel array.

Figure 3:
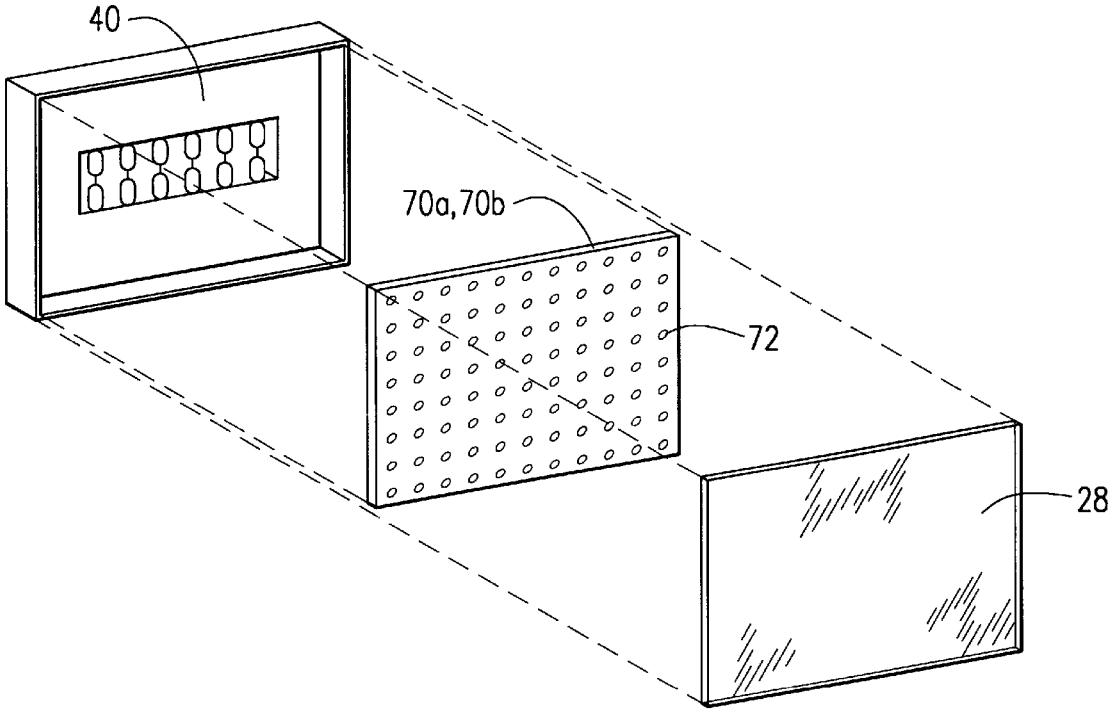
FIG. 3 is a drawing of the invention with the colored light diffuser plate.

In FIG. 3, a further illustration of the colorized diffusion panel 70*a*, 70*b* is shown. At this time, in the known art, bright white LED lamps 68 provide illuminating light, but often the light is observed as a grey light due to the bright white LED lamps 68 only emitting light in a portion of the visible spectrum as opposed to the full visible spectrum. Some colors under this bright white LED light appear to be washed or grey. The colorized diffusion panel 70*a*, 70*b*, placed in front of the bright white LED light source 40*a*, 4*b*, provides enhanced visible spectrum illumination, wherein the colorized diffusion panel 70*a*, 70*b* includes a dense array of green, blue, yellow and red transparent colored dot matrix 72 . As the emitted bright white LED light is passed through the transparent colored dot matrix 72, the light takes on the wavelength of the colored dots. The human eye, observing a full color spectrum of light, perceives the combination of colored light as "white", making the illuminated area appear more vibrant. At some point, when bright white LED lights are developed to broadcast light in a full color spectrum, this colorized diffusion panel 70 may be eliminated. In addition, the colorized diffusion panel 70*a*also disperses the light and spreads it about the illuminated area. In this sense, the colorized diffusion panel may be multi-faceted or provided in a wide array of gemstone of geometrically varied shapes and thicknesses. Another embodiment would provide the colorized diffusion panel 70 placed between the bright white LED light source 40 and a transparent diffusion globe 28, further illustrated in FIG. 3 of the drawings.

In the flush mounted ceiling fixture embodiment, the low voltage DC current bright white LED light fixture 20*a*, as shown in FIG. 6 of the drawings, may include a flush mounted ceiling housing 22, at least one bright white LED cluster 60*c*, a reflective backing plate 24 above the bright white LED cluster 60*c*, and a colorized diffusion panel 70*b* below the bright white LED cluster 60*c*. This flush mounted ceiling fixture 20*a* would then be connected by the paired wire connections 25*a* to a pair of the attachment terminals 34*a* of the multiple terminal low voltage power supply 30*a* after being installed into the ceiling 100*a*, as shown in FIG. 1 of the drawings.

The DC light switch 80*a*, 80*b* may be installed in a wall of the area to be illuminated by the invention or it may be incorporated into the bright white LED light fixtures 20*a*, 20*b*. This DC light switch 80*a*, 80*b* is preferred over AC light switches because low voltage DC current is a much lower safety risk than is household AC current, low voltage DC current not capable of accidental and fatal electrocution or general fire ignition.

The DC dimmer switch 82*a*, 82*b* may also be installed in a wall of the area to be illuminated, it may be incorporated into the DC light switch or it may be located within the bright white LED light fixture 20*a*, 20*b*. Again, this DC dimmer switch 82*a*, 82*b* is preferred over AC dimmer switches because of the low voltage DC current being a much lower safety risk than household AC current, and the DC dimmer switch not creating a high a resistance as an AC dimmer switch, reducing the heat output of the dimmer switch, which is usually created by a variable rheostat mechanism.

The auxiliary power terminal 90*a*, 90*b* has attached a length of DC wire 92*a*, 92*b*, connecting to a battery backup or to an alternate DC power supply, including an automobile battery.

While the invention has been particularly shown and described with reference to a preferred embodiment thereof, it will be understood by those skilled in the art that changes in form and detail may be made therein without departing from the spirit and scope of the invention.

What is claimed is:

1. An interior light fixture using bright white LEDs for an illumination source, powered by low voltage DC current, the device comprising:

a multiple terminal low voltage power supply wired into a standard household or commercial electrical system, said multiple terminal low voltage power supply including a transformer converting 110 and 220 volt AC current to low voltage DC current, said multiple terminal low voltage power supply further having a paired wire connection connecting to a pair of attachment terminals;

one or more low voltage DC current bright white LED light fixtures comprising a flush mounted ceiling housing, at least on bright white LED light source, comprised from a plurality of bright white LED lamps, a reflective backing plate above said bright white LED light source, and a colorized diffusion panel below said bright white LED light source;

a DC light switch;

a DC dimmer switch; and an auxiliary power terminal attached to an alternate DC power supply in the event of an AC power outage.

2. An interior light fixture using bright white LEDs for an illumination source, powered by low voltage DC current, the device comprising:

a multiple terminal low voltage power supply wired into a standard household or commercial electrical system, the multiple terminal low voltage power supply including a transformer converting 110 and 220 volt AC current to low voltage DC current;

one or more low voltage DC current bright white LED light fixtures containing one or more bright white LED light sources, comprised from a plurality of bright white LED lamps;

a colorized diffusion panel, having a colored dot matrix of green, blue, yellow and red transparent color dots, positioned in front of said bright white LED light source causing said bright white LED light source to emit a full color spectrum of visible light;

a DC light switch;

a DC dimmer switch; and an auxiliary power terminal which may be attached to an alternate DC power supply in the event of an AC power outage.

* * * * *